US009620129B2

(12) United States Patent
Helmrich et al.

(10) Patent No.: US 9,620,129 B2
(45) Date of Patent: Apr. 11, 2017

(54) APPARATUS AND METHOD FOR CODING A PORTION OF AN AUDIO SIGNAL USING A TRANSIENT DETECTION AND A QUALITY RESULT

(71) Applicant: Fraunhofer-Gesellschaft zur Foerderung der angewandten Forschung e.V., Munich (DE)

(72) Inventors: Christian Helmrich, Erlangen (DE); Guillaume Fuchs, Erlangen (DE); Goran Markovic, Nuremberg (DE)

(73) Assignee: Fraunhofer-Gesellschaft zur Foerderung der angewandten Forschung e.V., Munich (DE)

( * ) Notice: Subject to any disclaimer, the term of this patent is extended or adjusted under 35 U.S.C. 154(b) by 0 days.

(21) Appl. No.: 13/966,688

(22) Filed: Aug. 14, 2013

(65) Prior Publication Data

US 2013/0332177 A1 Dec. 12, 2013

Related U.S. Application Data

(63) Continuation of application No. PCT/EP2012/052396, filed on Feb. 13, 2012.
(Continued)

(51) Int. Cl.
*G10L 19/00* (2013.01)
*G10L 19/012* (2013.01)
(Continued)

(52) U.S. Cl.
CPC ..... *G10L 19/00* (2013.01); *G10K 11/16* (2013.01); *G10L 19/005* (2013.01);
(Continued)

(58) Field of Classification Search
CPC ..... G10L 19/22; G10L 19/24; G10L 19/18; G10L 19/02; G10L 19/20
(Continued)

(56) References Cited

U.S. PATENT DOCUMENTS 4,440,141 A 4/1984 Tsujimura et al.
4,711,212 A 12/1987 Haraguchi et al.
(Continued)

FOREIGN PATENT DOCUMENTS

AU 2007/312667 4/2008
CA 2730239 A1 1/2010
(Continued)

OTHER PUBLICATIONS

"Digital Cellular Telecommunications System (Phase 2+); Universal Mobile Telecommunications System (UMTS); LTE; Speech codec speech processing functions; Adaptive Multi-Rate-Wideband (AMR-)WB Speech Codec; Transcoding Functions (3GPP TS 26.190 version 9.0.0", Technical Specification, European Telecommunications Standards Institute (ETSI) 650, Route Des Lucioles; F-06921 Sophia-Antipolis; France; No. V.9.0.0, Jan. 1, 2012, 54 Pages.
(Continued)

*Primary Examiner* — Michael Colucci
(74) *Attorney, Agent, or Firm* — Michael A. Glenn; Perkins Coie LLP

(57) ABSTRACT

An apparatus for coding a portion of an audio signal to obtain an encoded audio signal for the portion of the audio signal includes a transient detector for detecting whether a transient signal is located in the portion of the audio signal to obtain a transient detection result, an encoder stage for performing first and second encoding algorithms on the audio signal, the first and second encoding algorithms having differing first and second characteristics, respectively, a
(Continued)

processor for determining which encoding algorithm results in an encoded audio signal being a better approximation to the portion of the audio signal with respect to the other encoding algorithm to obtain a quality result, and a controller for determining whether the encoded audio signal for the portion of the audio signal is to be generated by either the first or the second encoding algorithm based on the transient-detection and quality results.

11 Claims, 7 Drawing Sheets

Related U.S. Application Data

(60) Provisional application No. 61/442,632, filed on Feb. 14, 2011.

(51) Int. Cl.

| | |
|---|---|
| ***G10K 11/16*** | (2006.01) |
| ***G10L 19/005*** | (2013.01) |
| ***G10L 19/12*** | (2013.01) |
| ***G10L 19/03*** | (2013.01) |
| ***G10L 19/22*** | (2013.01) |
| ***G10L 21/0216*** | (2013.01) |
| ***G10L 25/78*** | (2013.01) |
| *G10L 19/26* | (2013.01) |
| *G10L 19/04* | (2013.01) |
| *G10L 19/02* | (2013.01) |
| *G10L 25/06* | (2013.01) |
| *G10L 19/025* | (2013.01) |
| *G10L 19/107* | (2013.01) |

(52) U.S. Cl.
CPC ..... *G10L 19/012* (2013.01); *G10L 19/03* (2013.01); *G10L 19/12* (2013.01); *G10L 19/22* (2013.01); *G10L 21/0216* (2013.01); *G10L 25/78* (2013.01); *G10L 19/025* (2013.01); *G10L 19/0212* (2013.01); *G10L 19/04* (2013.01); *G10L 19/107* (2013.01); *G10L 19/26* (2013.01); *G10L 25/06* (2013.01)

(58) Field of Classification Search
USPC ..... 704/223, 203, 219, 205, 500; 375/243; 381/98
See application file for complete search history.

(56) References Cited

U.S. PATENT DOCUMENTS 5,537,510 A 7/1996 Kim
5,598,506 A 1/1997 Wigren et al.
5,606,642 A 2/1997 Stautner et al.
5,684,920 A 11/1997 Iwakami et al.
5,727,119 A 3/1998 Davidson et al.
5,848,391 A 12/1998 Bosi et al.
5,890,106 A 3/1999 Bosi-Goldberg et al.
5,953,698 A 9/1999 Hayata
5,960,389 A 9/1999 Jarvinen et al.
6,070,137 A 5/2000 Bloebaum et al.
6,122,338 A 9/2000 Yamauchi
6,134,518 A 10/2000 Cohen et al.
6,173,257 B1 1/2001 Gao
6,236,960 B1 5/2001 Peng et al.
6,317,117 B1 11/2001 Goff
6,532,443 B1 3/2003 Nishiguchi et al.
6,587,817 B1 7/2003 Vähätalo et al.
6,636,829 B1 10/2003 Benyassine et al.
6,636,830 B1 10/2003 Princen et al.
6,680,972 B1 1/2004 Liljeryd et al.
6,757,654 B1 6/2004 Westerlund et al.
6,879,955 B2 4/2005 Rao et al.
6,969,309 B2 11/2005 Carpenter
6,980,143 B2 12/2005 Linzmeier et al.
7,003,448 B1 2/2006 Lauber et al.
7,124,079 B1 10/2006 Johansson et al.
7,249,014 B2 7/2007 Kannan et al.
7,280,959 B2 10/2007 Bessette
7,343,283 B2 3/2008 Ashley et al.
7,363,218 B2 4/2008 Jabri et al.
7,403,847 B2 7/2008 Matsuda et al.
7,519,535 B2 4/2009 Spindola
7,519,538 B2 4/2009 Villemoes et al.
7,536,299 B2 5/2009 Cheng et al.
7,565,286 B2 7/2009 Gracie et al.
7,587,312 B2 9/2009 Kim
7,627,469 B2 * 12/2009 Nettre ..... G10L 19/032 375/243
7,707,034 B2 4/2010 Sun et al.
7,711,563 B2 5/2010 Chen
7,788,105 B2 8/2010 Miseki
7,801,735 B2 9/2010 Thumpudi et al.
7,809,556 B2 10/2010 Goto et al.
7,860,720 B2 12/2010 Thumpudi et al.
7,873,511 B2 1/2011 Herre et al.
7,877,253 B2 1/2011 Krishnan et al.
7,917,369 B2 3/2011 Lee et al.
7,930,171 B2 4/2011 Chen et al.
7,933,769 B2 4/2011 Bessette
7,979,271 B2 7/2011 Bessette
7,987,089 B2 7/2011 Krishnan et al.
8,045,572 B1 10/2011 Li et al.
8,078,458 B2 12/2011 Zopf et al.
8,121,831 B2 2/2012 Oh et al.
8,160,274 B2 * 4/2012 Bongiovi ..... H04R 1/005 381/100
8,239,192 B2 8/2012 Kovesi et al.
8,255,207 B2 8/2012 Vaillancourt et al.
8,255,213 B2 8/2012 Yoshida et al.
8,363,960 B2 * 1/2013 Petersohn ..... G06F 17/30802 348/700
8,364,472 B2 1/2013 Ehara
8,428,936 B2 4/2013 Mittal et al.
8,428,941 B2 * 4/2013 Boehm ..... G10L 19/24 704/219
8,452,884 B2 * 5/2013 Wang ..... H04N 21/643 709/219
8,566,106 B2 10/2013 Salami et al.
8,630,862 B2 1/2014 Geiger et al.
8,630,863 B2 1/2014 Son et al.
8,635,357 B2 * 1/2014 Ebersviller ..... H04N 19/46 709/224
8,700,388 B2 4/2014 Edler et al.
8,825,496 B2 9/2014 Setiawan et al.
8,954,321 B1 2/2015 Beack et al.
2001/0002590 A1 6/2001 Cianciara et al.
2002/0111799 A1 8/2002 Bernard
2002/0176353 A1 11/2002 Atlas et al.
2002/0184009 A1 12/2002 Heikkinen
2003/0009325 A1 1/2003 Kirchherr et al.
2003/0033136 A1 2/2003 Lee
2003/0046067 A1 3/2003 Gradl
2003/0078771 A1 4/2003 Jung et al.
2003/0089353 A1 5/2003 Gerhardt et al.
2003/0225576 A1 12/2003 Li et al.
2004/0010329 A1 1/2004 Lee et al.
2004/0046236 A1 3/2004 Collier
2004/0093204 A1 5/2004 Byun et al.
2004/0093368 A1 5/2004 Lee et al.
2004/0184537 A1 9/2004 Geiger et al.
2004/0193410 A1 9/2004 Lee et al.
2004/0220805 A1 11/2004 Geiger et al.
2004/0225505 A1 11/2004 Andersen et al.
2005/0021338 A1 1/2005 Graboi et al.
2005/0065785 A1 3/2005 Bessette
2005/0080617 A1 4/2005 Koshy et al.
2005/0091044 A1 4/2005 Ramo et al.
2005/0096901 A1 5/2005 Uvliden et al.
2005/0130321 A1 6/2005 Nicholson et al.
2005/0131696 A1 6/2005 Wang et al.

(56) References Cited

U.S. PATENT DOCUMENTS

2005/0154584 A1 7/2005 Jelinek et al.
2005/0165603 A1 7/2005 Bessette et al.
2005/0192798 A1 9/2005 Vainio et al.
2005/0240399 A1* 10/2005 Makinen ..... G10L 19/22 704/223
2005/0278171 A1 12/2005 Suppappola et al.
2006/0095253 A1 5/2006 Schuller et al.
2006/0115171 A1 6/2006 Geiger et al.
2006/0116872 A1 6/2006 Byun et al.
2006/0173675 A1 8/2006 Ojanpera et al.
2006/0206334 A1 9/2006 Kapoor et al.
2006/0210180 A1 9/2006 Geiger et al.
2006/0271356 A1 11/2006 Vos
2006/0293885 A1 12/2006 Gournay et al.
2007/0016404 A1 1/2007 Kim et al.
2007/0050189 A1 3/2007 Cruz-Zeno et al.
2007/0100607 A1 5/2007 Villemoes
2007/0147518 A1* 6/2007 Bessette ..... G10L 19/0212 375/243
2007/0160218 A1 7/2007 Jakka et al.
2007/0171931 A1 7/2007 Manjunath et al.
2007/0172047 A1 7/2007 Coughlan et al.
2007/0174047 A1 7/2007 Anderson et al.
2007/0196022 A1 8/2007 Geiger et al.
2007/0225971 A1* 9/2007 Bessette ..... G10L 19/0208 704/203
2007/0253577 A1 11/2007 Yen et al.
2007/0282603 A1* 12/2007 Bessette ..... 704/219
2008/0010064 A1 1/2008 Takeuchi et al.
2008/0015852 A1 1/2008 Kruger et al.
2008/0027719 A1 1/2008 Kirshnan et al.
2008/0046236 A1 2/2008 Thyssen et al.
2008/0052068 A1 2/2008 Aguilar et al.
2008/0097764 A1 4/2008 Grill et al.
2008/0120116 A1 5/2008 Schnell et al.
2008/0147415 A1 6/2008 Schnell et al.
2008/0208599 A1 8/2008 Rosec et al.
2008/0221905 A1 9/2008 Schnell et al.
2008/0249765 A1 10/2008 Schuijers et al.
2008/0275580 A1 11/2008 Andersen
2009/0024397 A1 1/2009 Ryu et al.
2009/0076807 A1 3/2009 Xu et al.
2009/0110208 A1 4/2009 Choo et al.
2009/0204412 A1 8/2009 Kovesi et al.
2009/0226016 A1 9/2009 Fitz et al.
2009/0228285 A1 9/2009 Schnell et al.
2009/0232053 A1 9/2009 Taki et al.
2009/0319283 A1 12/2009 Schnell et al.
2009/0326930 A1 12/2009 Kawashima et al.
2009/0326931 A1 12/2009 Ragot et al.
2010/0017200 A1 1/2010 Oshikiri et al.
2010/0017213 A1 1/2010 Edler et al.
2010/0049511 A1 2/2010 Ma et al.
2010/0063811 A1 3/2010 Gao et al.
2010/0063812 A1 3/2010 Gao
2010/0070270 A1 3/2010 Gao
2010/0106496 A1 4/2010 Morii et al.
2010/0138218 A1* 6/2010 Geiger ..... G10L 19/02 704/205
2010/0198586 A1 8/2010 Edler et al.
2010/0217607 A1 8/2010 Neuendorf et al.
2010/0262420 A1 10/2010 Herre et al.
2010/0268542 A1* 10/2010 Kim ..... G10L 19/22 704/501
2010/0278062 A1 11/2010 Abraham et al.
2011/0002393 A1* 1/2011 Suzuki ..... G10L 19/008 375/240.18
2011/0007827 A1 1/2011 Virette et al.
2011/0106542 A1 5/2011 Bayer et al.
2011/0153333 A1* 6/2011 Bessette ..... G10L 19/26 704/500
2011/0161088 A1 6/2011 Bayer et al.
2011/0173010 A1 7/2011 Lecomte et al.
2011/0173011 A1 7/2011 Geiger et al.
2011/0178795 A1 7/2011 Bayer et al.
2011/0218797 A1 9/2011 Mittal et al.
2011/0218799 A1 9/2011 Mittal et al.
2011/0218801 A1 9/2011 Vary et al.
2011/0257979 A1 10/2011 Gao
2011/0270616 A1 11/2011 Garudadri et al.
2011/0311058 A1 12/2011 Oh et al.
2012/0226505 A1 9/2012 Lin et al.
2012/0271644 A1 10/2012 Bessette et al.
2013/0322416 A1 12/2013 Son
2013/0332151 A1 12/2013 Fuchs et al.
2013/0340512 A1 12/2013 Horlbeck et al.
2014/0257824 A1* 9/2014 Taleb ..... G10L 19/20 704/500

FOREIGN PATENT DOCUMENTS

CN 1274456 A 11/2000
CN 1344067 A 4/2002
CN 1381956 A 11/2002
CN 1437747 A 8/2003
CN 1539137 A 10/2004
CN 1539138 A 10/2004
CN 101351840 10/2006
CN 101110214 A 1/2008
CN 101366077 A 2/2009
CN 101371295 A 2/2009
CN 101379551 A 3/2009
CN 101388210 A 3/2009
CN 101425292 A 5/2009
CN 101483043 A 7/2009
CN 101488344 A 7/2009
CN 101743587 6/2010
CN 101770775 A 7/2010
DE 102008015702 A1 8/2009
EP 0665530 A1 8/1995
EP 0673566 A1 9/1995
EP 0758123 A2 2/1997
EP 0784846 A1 7/1997
EP 1120775 A1 8/2001
EP 0843301 B1 9/2003
EP 1852851 7/2007
EP 1845520 A1 10/2007
EP 2107556 7/2009
EP 2109098 A2 10/2009
EP 2144230 A1 1/2010
FR 2911228 A1 7/2008
JP H08-181619 A 7/1996
JP H08263098 A 10/1996
JP 10039898 A 2/1998
JP H10-105193 A 4/1998
JP H10214100 A 8/1998
JP H10-276095 A 10/1998
JP H11502318 A 2/1999
JP H1198090 A 4/1999
JP 2000357000 A 12/2000
JP 2002-118517 4/2002
JP 2003501925 A 1/2003
JP 2003506764 A 2/2003
JP 2003-195881 A 7/2003
JP 2004513381 A 4/2004
JP 2004514182 A 5/2004
JP 2004-246038 A 9/2004
JP 2005534950 A 11/2005
JP 2006504123 A 2/2006
JP 2007065636 A 3/2007
JP 2007523388 A 8/2007
JP 2007525707 A 9/2007
JP 2007538282 A 12/2007
JP 2008-15281 1/2008
JP 2008513822 A 5/2008
JP 2008261904 A 10/2008
JP 2009508146 A 2/2009
JP 2009075536 A 4/2009
JP 2009522588 A 6/2009
JP 2009-527773 7/2009
JP 2009530084 A 8/2009
JP 2010530084 9/2010
JP 2010-532883 A 10/2010

(56) References Cited

FOREIGN PATENT DOCUMENTS

| | | | |
|---|---|---|---|
| JP | 2010-538314 | | 12/2010 |
| JP | 2010539528 | A | 12/2010 |
| JP | 2011501511 | A | 1/2011 |
| JP | 2011527444 | A | 10/2011 |
| KR | 1020040043278 | A | 5/2004 |
| KR | 1020060025203 | A | 3/2006 |
| KR | 1020070088276 | A | 8/2007 |
| KR | 20080032160 | A | 4/2008 |
| KR | 1020100059726 | A | 6/2010 |
| KR | 1020100134709 | | 4/2015 |
| RU | 2169992 | C2 | 6/2001 |
| RU | 2183034 | C2 | 5/2002 |
| RU | 2003118444 | A | 12/2004 |
| RU | 2004138289 | A | 6/2005 |
| RU | 2296377 | C2 | 3/2007 |
| RU | 2302665 | C2 | 7/2007 |
| RU | 2312405 | C2 | 12/2007 |
| RU | 2331933 | C2 | 8/2008 |
| RU | 2335809 | C2 | 10/2008 |
| RU | 2008126699 | A | 2/2010 |
| RU | 2009107161 | A | 9/2010 |
| RU | 2009118384 | A | 11/2010 |
| TW | 200830277 | | 10/1996 |
| TW | 200943279 | | 10/1998 |
| TW | 201032218 | | 9/1999 |
| TW | 380246 | | 1/2000 |
| TW | 469423 | | 12/2001 |
| TW | I253057 | B | 4/2006 |
| TW | 200703234 | | 1/2007 |
| TW | 200729156 | | 8/2007 |
| TW | 200841743 | A | 10/2008 |
| TW | I313856 | B | 8/2009 |
| TW | 200943792 | | 10/2009 |
| TW | I316225 | | 10/2009 |
| TW | I 320172 | | 2/2010 |
| TW | 201009810 | | 3/2010 |
| TW | 201009812 | A | 3/2010 |
| TW | I324762 | | 5/2010 |
| TW | 201027517 | A | 7/2010 |
| TW | 201030735 | A | 8/2010 |
| TW | 201040943 | | 11/2010 |
| TW | I333643 | B | 11/2010 |
| TW | 201103009 | | 1/2011 |
| WO | 92/22891 | A1 | 12/1992 |
| WO | 95/10890 | A1 | 4/1995 |
| WO | 95/30222 | A1 | 11/1995 |
| WO | 96/29696 | A1 | 9/1996 |
| WO | 00/31719 | A2 | 6/2000 |
| WO | 0075919 | A1 | 12/2000 |
| WO | 02/101724 | A1 | 12/2002 |
| WO | WO-02101722 | | 12/2002 |
| WO | 2004027368 | A1 | 4/2004 |
| WO | 2005/041169 | A2 | 5/2005 |
| WO | 2005078706 | A1 | 8/2005 |
| WO | 2005081231 | A1 | 9/2005 |
| WO | 2005112003 | A1 | 11/2005 |
| WO | 2006082636 | A1 | 8/2006 |
| WO | WO-2006126844 | | 11/2006 |
| WO | 2006/137425 | A1 | 12/2006 |
| WO | WO-2007051548 | | 5/2007 |
| WO | 2007083931 | A1 | 7/2007 |
| WO | WO-2007073604 | | 7/2007 |
| WO | WO2007/096552 | | 8/2007 |
| WO | WO-2008013788 | | 10/2008 |
| WO | 2008/157296 | A1 | 12/2008 |
| WO | WO-2009029032 | | 3/2009 |
| WO | 2009077321 | A3 | 10/2009 |
| WO | 2009121499 | A1 | 10/2009 |
| WO | 2010/003563 | A1 | 1/2010 |
| WO | 2010003491 | A1 | 1/2010 |
| WO | WO-2010/003491 | | 1/2010 |
| WO | WO-2010040522 | | 4/2010 |
| WO | 2010059374 | A1 | 5/2010 |
| WO | 2010081892 | A2 | 7/2010 |
| WO | 2010093224 | A2 | 8/2010 |
| WO | 2011/006369 | A1 | 1/2011 |
| WO | WO-2010003532 | | 2/2011 |
| WO | 2011/048117 | A1 | 4/2011 |
| WO | WO-2011048094 | | 4/2011 |
| WO | 2011/147950 | A1 | 12/2011 |
| WO | 2012/022881 | | 2/2012 |

OTHER PUBLICATIONS

"IEEE Signal Processing Letters", IEEE Signgal Processing Society. vol. 15. ISSN 1070-9908., 2008, 9 Pages.

"Information Technology—MPEG Audio Technologies—Part 3: Unified Speech and Audio Coding", ISO/IEC JTC 1/SC 29 ISO/IEC DIS 23003-3, Feb. 9, 2011, 233 Pages.

"WD7 of USAC", International Organisation for Standardisation Organisation Internationale De Normailisation. ISO/IEC JTC1/SC29/WG11. Coding of Moving Pictures and Audio. Dresden, Germany., Apr. 2010, 148 Pages.

3GPP, "3rd Generation Partnership Project; Technical Specification Group Service and System Aspects. Audio Codec Processing Functions. Extended AMR Wideband Codec; Transcoding functions (Release 6).", 3GPP Draft; 26.290, V2.0.0 3rd Generation Partnership Project (3GPP), Mobile Competence Centre; Valbonne, France., Sep. 2004, 1-85.

Ashley, J et al., "Wideband Coding of Speech Using a Scalable Pulse Codebook", 2000 IEEE Speech Coding Proceedings., Sep. 17, 2000, 148-150.

Bessette, B et al., "The Adaptive Multirate Wideband Speech Codec (AMR-WB)", IEEE Transactions on Speech and Audio Processing, IEEE Service Center. New York. vol. 10, No. 8., Nov. 1, 2002, 620-636.

Bessette, B et al., "Universal Speech/Audio Coding Using Hybrid ACELP/TCX Techniques", ICASSP 2005 Proceedings. IEEE International Conference on Acoustics, Speech, and Signal Processing, vol. 3,, Jan. 2005, 301-304.

Bessette, B et al., "Wideband Speech and Audio Codec at 16/24/32 Kbit/S Using Hybrid ACELP/TCX Techniques", 1999 IEEE Speech Coding Proceedings. Porvoo, Finland., Jun. 20, 1999, 7-9.

Ferreira, A et al., "Combined Spectral Envelope Normalization and Subtraction of Sinusoidal Components in the ODFTand MDCT Frequency Domains", 2001 IEEE Workshop on Applications of Signal Processing to Audio and Acoustics., Oct. 2001, pp. 51-54.

Fischer, et al., "Enumeration Encoding and Decoding Algorithms for Pyramid Cubic Lattice and Trellis Codes", IEEE Transactions on Information Theory. IEEE Press, USA, vol. 41, No. 6, Part 2., Nov. 1, 1995, 2056-2061.

Hermansky, H et al., "Perceptual linear predictive (PLP) analysis of speech", J. Acoust. Soc. Amer. 87 (4)., 1990, 1738-1751.

Hofbauer, K et al., "Estimating Frequency and Amplitude of Sinusoids in Harmonic Signals—A Survey and the Use of Shifted Fourier Transforms", Graz: Graz University of Technology; Graz University of Music and Dramatic Arts., 2004.

Lanciani, C et al., "Subband-Domain Filtering of MPEG Audio Signals", 1999 IEEE International Conference on Acoustics, Speech, and Signal Processing. Phoenix, , AZ, USA., Mar. 15, 1999, 917-920.

Lauber, P et al., "Error Concealment for Compressed Digital Audio", Presented at the 111th AES Convention. Paper 5460. New York, USA., Sep. 21, 2001, 12 Pages.

Lee, Ick Don et al., "A Voice Activity Detection Algorithm for Communication Systems with Dynamically Varying Background Acoustic Noise", Dept. of Electical Engineering, 1998 IEEE.

Makinen, J et al., "AMR-WB+: a New Audio Coding Standard for 3rd Generation Mobile Audio Services", 2005 IEEE International Conference on Acoustics, Speech, and Signal Processing. Philadelphia, PA, USA., Mar. 18, 2005, 1109-1112.

Motlicek, P et al., "Audio Coding Based on Long Temporal Contexts", Rapport de recherche de l'IDIAP 06-30, Apr. 2006, 1-10.

Neuendorf, M et al., "A Novel Scheme for Low Bitrate Unified Speech Audio Coding—MPEG RMO", AES 126th Convention. Convention Paper 7713. Munich, Germany, May 1, 2009, 13 Pages.

Neuendorf, M et al., "Completion of Core Experiment on unification of USAC Windowing and Frame Transitions", International

(56) References Cited

OTHER PUBLICATIONS

Organisation for Standardisation Organisation Internationale De Normalisation ISO/IEC JTC1/SC29/WG11. Coding of Moving Pictures and Audio. Kyoto, Japan., Jan. 2010, 52 Pages.
Neuendorf, M et al., "Unified Speech and Audio Coding Scheme for High Quality at Low Bitrates", ICASSP 2009 IEEE International Conference on Acoustics, Speech and Signal Processing. Psicataway, NJ, USA., Apr. 19, 2009, 4 Pages.
Patwardhan, P et al., "Effect of Voice Quality on Frequency-Warped Modeling of Vowel Spectra", Speech Communication. vol. 48, No. 8., 2006, 1009-1023.
Ryan, D et al., "Reflected Simplex Codebooks for Limited Feedback MIMO Beamforming", IEEE. XP31506379A., 2009, 6 Pages.
Sjoberg, J et al., "RTP Payload Format for the Extended Adaptive Multi-Rate Wideband (AMR-WB+) Audio Codec", Memo. The Internet Society. Network Working Group. Catagory: Standards Track., 2006, 1-38.
Terriberry, T et al., "A Multiply-Free Enumeration of Combinations with Replacement and Sign", IEEE Signal Processing Letters. vol. 15, 2008, 11 Pages.
Terriberry, T et al., "Pulse Vector Coding", Retrieved from the internet on Oct. 12, 2012. XP55025946. URL:http://people.xiph.org/~tterribe/pubs/cwrs.pdf, Dec. 1, 2007, 4 Pages.
Virette, D et al., "Enhanced Pulse Indexing CE for ACELP in USAC", Organisation Internationale De Normalisation ISO/IEC JTC1/SC29/WG11. MPEG2012/M19305. Coding of Moving Pictures and Audio. Daegu, Korea., Jan. 2011, 13 Pages.
Wang, F et al., "Frequency Domain Adaptive Postfiltering for Enhancement of Noisy Speech", Speech Communication 12. Elsevier Science Publishers. Amsterdam, North-Holland. vol. 12, No. 1., Mar. 1993, 41-56.
Waterschoot, T et al., "Comparison of Linear Prediction Models for Audio Signals", EURASIP Journal on Audio, Speech, and Music Processing. vol. 24., 2008.
Zernicki, T et al., "Report on CE on Improved Tonal Component Coding in eSBR", International Organisation for Standardisation Organisation Internationale De Normalisation ISO/IEC JTC1/SC29/WG11. Coding of Moving Pictures and Audio. Daegu, South Korea, Jan. 2011, 20 Pages.
A Silence Compression Scheme for G.729 Optimized for Terminals Conforming to Recommendation V.70, ITU-T Recommendation G.729—Annex B, International Telecommunication Union, pp. 1-16., Nov. 1996.
Martin, R., Spectral Subtraction Based on Minimum Statistics, Proceedings of European Signal Processing Conference (EUSIPCO), Edinburg, Scotland, Great Britain, Sep. 1994, pp. 1182-1185.
Lefebvre, R. et al., "High quality coding of wideband audio signals using transform coded excitation (TCX)", 1994 IEEE International Conference on Acoustics, Speech, and Signal Processing, Apr. 19-22, 1994, pp. I/193 to I/196 (4 pages).
3GPP, TS 26.290 version 9.0.0 (Jan. 2010), Digital cellular telecommunications system (Phase 2+), Universal Mobile Telecommunications System (UMTS); LTE; Audio codec processing functions; Extended Adaptive Multi-Rate-Wideband (AMR-WB+) codec; Transcoding functions (3GPP TS 26.290 version 9.0.0 release 9), Chapter 5.3, Jan. 2010, pp. 24-39.
Britanak, et al., "A new fast algorithm for the unified forward and inverse MDCT/MDST computation", Signal Processing, vol. 82, Mar. 2002, pp. 433-459.
Herley, C. et al., "Tilings of the Time-Frequency Plane: Construction of Arbitrary Orthogonal Bases and Fast Tilings Algorithms", IEEE Transactions on Signal Processing , vol. 41, No. 12, Dec. 1993, pp. 3341-3359.
Fuchs, et al., "MDCT-Based Coder for Highly Adaptive Speech and Audio Coding", 17th European Signal Processing Conference (EUSIPCO 2009), Glasgow, Scotland, Aug. 24-28, 2009, pp. 1264-1268.
Song, et al., "Research on Open Source Encoding Technology for MPEG Unified Speech and Audio Coding", Journal of the Institute of Electronics Engineers of Korea vol. 50 No. 1, Jan. 2013, pp. 86-96.

* cited by examiner

| encoding algorithm | transient signals | non-transient signals |
|---|---|---|
| ACELP | X | |
| TCX 20 | | X |

FIGURE 2

ACELP ——— TCX20 switch-over

1. Quality Condition

If quality condition indicates
high quality distance (e.g. more than 1dB SNR)
switch over to higher quality encoding algorithm.

2. Transient Condition

If quality condition indicates
small quality distance (e.g. 1 or less dB SNR)
switch over to lower quality encoding algorithm,
when transient detection result indicates that lower quality
encoding algorithm fits to the audio signal characteristic
otherwise switch to higher quality encoding algorithm.

3. Hysteresis condition

Only switch to lower quality encoding algorithm,
when less than the last N frames have been encoded
with the other algorithm (e.g. N=5).

FIGURE 3

| earlier frames | 0 | X | 0 | X | X |
|---|---|---|---|---|---|
| > N TCX | 0 | X | X | 0 | X |
| > N ACELP | X | 0 | X | 0 | 0 |
| < N TCX | 0 | X | X | 0 | 0 |
| < N ACELP | X | 0 | 0 | X | X |
| | high quality distance for TCX | high quality distance for ACELP | low quality distance for TCX and transient | low quality distance for ACELP and non-transient | |

41 42 43 44

X: switch-over
0: no switch-over

FIGURE 4

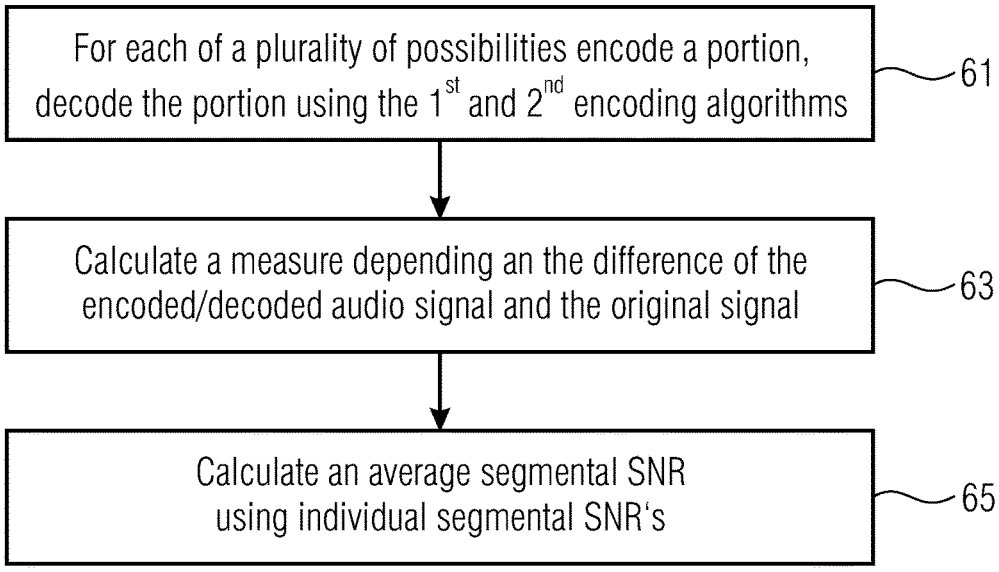

FIGURE 6A $$\mathrm{segSNR}_i = 20\log_{10}\left(\frac{\sum_{n=0}^{N-1} x_w^2(n)}{\sum_{n=0}^{N-1}\left(x_w(n) - \bar{x}_w(n)\right)^2}\right)$$

$x_w$: wighted audio signal $\bar{x}_w$: encoded/decoded weighted signal $$\overline{\mathrm{segSNR}} = \frac{1}{N_{SF}}\sum_{i=0}^{N_{SF}-1}\mathrm{segSNR}_i$$

1 superframe has four frames;
(1024) (256)
1 frame has four subframes;
(256) (64)

$N_{SF}$ = number of subframes in a frame i = sample number index

N = 64 $\hat{=}$ number of samples in a subframe

FIGURE 6B

APPARATUS AND METHOD FOR CODING A PORTION OF AN AUDIO SIGNAL USING A TRANSIENT DETECTION AND A QUALITY RESULT

CROSS-REFERENCE TO RELATED APPLICATIONS

This application is a continuation of copending International Application No. PCT/EP2012/052396, filed Feb. 13, 2012, which is incorporated herein by reference in its entirety, and additionally claims priority from U.S. Application No. 61/442,632, filed Feb. 14, 2011, which is also incorporated herein by reference in its entirety.

The present invention is related to audio coding and, particularly, to switched audio coding, where, for different time portions, the encoded signal is generated using different encoding algorithms.

BACKGROUND OF THE INVENTION

Switched audio coders which determine different encoding algorithms for different portions of the audio signal are known. An example is the so-called extended adaptive multi-rate-wideband codec or AMR-WB+ codec defined in the International Standard 3GPP TS 26.290 V6.1.0 2004-12. In this technical specification, the coding concept is described, which extends the ACELP (Algebraic Code Excited Linear Prediction) based AMR-WB codec by adding TCX (Transform Coded Excitation), bandwidth extension, and stereo. The AMR-WB+ audio codec processes input frames equal to 2048 samples at an internal sampling frequency $F_S$. The internal sampling frequency is limited to the range 12,800 to 38,400 Hz. The 2048 sample frames are split into two critically sampled equal frequency bands. This results in two superframes of 1024 samples corresponding to the low-frequency (LF) and high-frequency (HF) bands. Each superframe is divided into four 256-samples frames. Sampling at the internal sampling rate is obtained by using a variable sampling conversion scheme, which re-samples the input signal. The LF and HF signals are then encoded using two different approaches. The LF signal is encoded and decoded using the "core" encoder/decoder, based on switched ACELP and TCX. In the ACELP mode, the standard AMR-WB codec is used. The HF signal is encoded with relatively few bits (16 bits/frame) using a bandwidth extension (BWE) method.

The parameters transmitted from encoder to decoder are the mode-selection bits, the LF parameters and HF signal parameters. The parameters for each 1024-sample superframe are decomposed into four packets of identical size. When the input signal is stereo, the left and right channels are combined into mono-signals for a ACELP-TCX encoding, whereas the stereo encoding receives both input channels. In the AMR-WB+ decoder structure, the LF and HF bands are decoded separately. Then, the bands are combined in a synthesis filterbank. If the output is restricted to mono only, the stereo parameters are omitted and the decoder operates in mono mode.

The AMR-WB+ codec applies LP (Linear Prediction) analysis for both the ACELP and TCX modes, when encoding the LF signal. The LP coefficients are interpolated linearly at every 64-sample sub-frame. The LP analysis window is a half-cosine of length 384 samples. The coding mode is selected based on closed-loop analysis-by-synthesis method. Only 256 sample frames are considered for ACELP frames, whereas frames of 256, 512 or 1024 samples are possible in TCX mode. The ACELP coding consists of long-term prediction (LTP) analysis and synthesis and algebraic codebook excitation. In the TCX mode, a perceptually weighted signal is processed in the transform domain. The Fourier transformed weighted signal is quantized using split multi-weight lattice quantization (algebraic vector quantization). The transform is calculated in 1024, 512 or 256 sample windows. The excitation signal is recovered by inverse filtering a quantized weighted signal through the inverse weighting filter. In order to determine whether a certain portion of the audio signal is to be encoded using the ACELP mode or the TCX mode, a closed-loop mode selection or an open-loop mode selection is used. In a closed-loop mode selection, 11 successive trials are used. Subsequent to a trial, a mode selection is made between two modes to be compared. The selection criterion is the average segmental SNR (Signal Noise Ratio) between the weighted audio signal and the synthesized weighted audio signal. Hence, the encoder performs a complete encoding in both encoding algorithms, a complete decoding in accordance with both encoding algorithms and, subsequently, the results of both encoding/decoding operations are compared to the original signal. Hence, for each encoding algorithm, i.e., ACELP on the one hand and TCX on the other hand, a segmental SNR value is obtained and the encoding algorithm having the better segmental SNR value or having a better average segmental SNR value determined over a frame by averaging over the segmental SNR values for the individual sub-frames is used.

An additional switched audio coding scheme is the so-called USAC coder (USAC=Unified Speech Audio Coding). This coding algorithm is described in ISO/IEC 23003-3. The general structure can be described as follows. First, there is a common pre/post processing system of an MPEG Surround functional unit to handle stereo or multi-channel processing and an enhanced SBR unit generating the parametric representation of the higher audio frequencies of the input signal. Then, there are two branches, one consisting of a modified advanced audio coding (AAC) tool path and the other consisting of a linear prediction coding (LP or LPC domain) based path, which in turn features either a frequency-domain representation or a time-domain representation of the LPC residual. All transmitted spectra for both, AAC and LPC, are represented in MDCT domain following quantization and arithmetic coding. The time-domain representation uses an ACELP excitation coding scheme. The functions of the decoder are to find the description of the quantized audio spectra or time-domain representation in the bitstream payload and to decode the quantized values and other reconstruction information. Hence, the encoder performs two decisions. The first decision is to perform a signal classification for frequency domain versus linear prediction domain mode decision. The second decision is to determine, within the linear prediction domain (LPD), whether a signal portion is to be encoded using ACELP or TCX.

For applying a switched audio coding scheme in scenarios, where a very low delay may be used, particular attention has to be paid to transform-based coding parts, since these coding parts introduce a certain delay which depends on the transform length and window design. Therefore, the USAC coding concept is not suitable to very low-delay applications due to the modified AAC coding branch having a considerable transform length and length adaptation (also known as block switching) involving transitional windows.

On the other hand, the AMR-WB+ coding concept was found to be problematic due to the encoder-side decision whether ACELP or TCX is to be used. ACELP provides a good coding gain, but may result in significant audio quality problems when a signal portion is not suitable for the ACELP coding mode. Hence, for quality reasons, one might be inclined to use TCX whenever the input signal does not contain speech. However, using TCX too much at low bitrates will result in bitrate problems, since TCX provides a relatively low coding gain. When one, therefore, looks more onto the coding gain, one might use ACELP whenever possible, but, as stated before, this can result in audio quality problems due to the fact that ACELP is not optimal, for example, for music and similar stationary signals.

The segmental SNR calculation is a quality measure, which determines the better coding mode only based on the result, i.e., whether the SNR between the original signal or the encoded/decoded signal is better, so that the encoding algorithm resulting in a better SNR is used. This, however, has to operate under bitrate constraints. Therefore, it has been found that only using a quality measure such as, for example, the segmental SNR measure does not always result in the best compromise between quality and bitrate.

SUMMARY

According to an embodiment, an apparatus for coding a portion of an audio signal to acquire an encoded audio signal for the portion of the audio signal may have: a transient detector for detecting whether a transient signal is located in the portion of the audio signal to achieve a transient detection result; an encoder stage for performing a first encoding algorithm on the audio signal, the first encoding algorithm having a first characteristic, and for performing a second encoding algorithm on the audio signal, the second encoding algorithm having a second characteristic being different from the first characteristic; a processor for determining which encoding algorithm results in an encoded audio signal being a better approximation to the portion of the audio signal with respect to the other encoding algorithm to achieve a quality result; and a controller for determining whether the encoded audio signal for the portion of the audio signal is to be generated by either the first encoding algorithm or the second encoding algorithm based on the transient detection result and the quality result.

According to another embodiment, a method of coding a portion of an audio signal to acquire an encoded audio signal for the portion of the audio signal may have the steps of: detecting whether a transient signal is located in the portion of the audio signal to achieve a transient detection result; performing a first encoding algorithm on the audio signal, the first encoding algorithm having a first characteristic, and performing a second encoding algorithm on the audio signal, the second encoding algorithm having a second characteristic being different from the first characteristic; determining which encoding algorithm results in an encoded audio signal being a better approximation to the portion of the audio signal with respect to the other encoding algorithm to achieve a quality result; and determining whether the encoded audio signal for the portion of the audio signal is to be generated by either the first encoding algorithm or the second encoding algorithm based on the transient detection result and the quality result.

Another embodiment may have a computer program having a program code for performing, when running on a computer, the method of coding a portion of an audio signal in accordance with claim 10.

The present invention is based on the finding that a better decision between a first encoding algorithm suited for more transient signal portions and a second encoding algorithm suitable for more stationary signal portions can be obtained when the decision is not only based on a quality measure but, additionally, on a transient detection result. While the quality measure only looks at the result of the encoding/decoding chain with respect to the original signal, the transient detection result additionally relies on an analysis of the original input audio signal alone. Hence, it has been found out that a combination of both measures, i.e., the quality result on the one hand and the transient detection result on the other hand for finally determining whether a portion of an audio signal is to be encoded by which encoding algorithm leads to an improved compromise between coding gain on the one hand and audio quality on the other hand.

An apparatus for coding a portion of an audio signal to obtain an encoded audio signal for the portion of an audio signal comprises a transient detector for detecting whether a transient signal is located in the portion of the audio signal to obtain a transient detection result. The apparatus furthermore comprises an encoder stage for performing a first encoding algorithm on the audio signal, the first encoding algorithm having a first characteristic, and for performing a second encoding algorithm on the audio signal, the second encoding algorithm having a second characteristic being different from the first characteristic. In an embodiment, the first characteristic associated with the first encoding algorithm is better suited for a more transient signal, and the second encoding characteristic associated with the second encoding algorithm is better suited for more stationary audio signals. Exemplarily, the first encoding algorithm is an ACELP encoding algorithm and the second encoding algorithm is a TCX encoding algorithm which may be based on a modified discrete cosine transform, an FFT transform or any other transform or filterbank. Furthermore, a processor is provided for determining, which encoding algorithm results in an encoded audio signal being a better approximation to the portion of the audio signal to obtain a quality result. Furthermore, a controller is provided, where the controller is configured for determining whether the encoded audio signal for the portion of the audio signal is generated by either the first encoding algorithm or the second encoding algorithm. In accordance with the invention, the controller is configured for performing this determination not only based on the quality result but, additionally, on the transient detection result.

In an embodiment, the controller is configured for determining the second encoding algorithm, although the quality result indicates a better quality for the first encoding algorithm, when the transient detection result indicates a non-transient signal. Furthermore, the controller is configured for determining the first encoding algorithm, although the quality result indicates a better quality for the second encoding algorithm, when the transient detection result indicates a transient signal.

In a further embodiment, this determination, in which the transient result can negate the quality result, is enhanced using a hysteresis function such that the second encoding algorithm is only determined when a number of earlier signal portions, for which the first encoding algorithm has been determined, is smaller than a predetermined number. Analogously, the controller is configured to only determine the first encoding algorithm when a number of earlier signal portions, for which the second encoding algorithm has been determined in the past, is smaller than a predetermined number. An advantage from the hysteresis processing is that the number of switch-overs between coding modes is reduced for certain input signals. A too frequent switch-over at critical points in the signal may generate audible artifacts specifically for low bitrates. The probability of such artifacts is reduced by implementing the hysteresis.

In a further embodiment, the quality result is favored with respect to the transient detection result when the quality result indicates a strong quality advantage for one coding algorithm. Then, the encoding algorithm having the much better quality result than the other encoding algorithm is selected irrespective of whether the signal is a transient signal or not. On the other hand, the transient detection result can become decisive when the quality difference between both encoding algorithms is not so high. To this end, it is advantageous to not only determine a binary quality result, but a quantitative quality result. A binary quality result would only indicate which encoding algorithm results in a better quality, whereas a quantitative quality result not only determines which encoding algorithm results in a better quality, but how much better the corresponding encoding algorithm is. On the other hand, one could also use a quantitative transient detection result but, basically, a binary transient detection result would be sufficient as well.

Hence, the present invention provides a particular advantage with respect to a good compromise between bitrate on the one hand and quality on the other hand, since, for transient signals, the coding algorithm resulting in less quality is selected. When the quality result favors e.g. a TCX decision, nevertheless the ACELP mode is taken, which might result in a slightly reduced audio quality but, in the end, results in a higher coding gain associated with using the ACELP mode.

When, on the other hand, the quality result favors an ACELP frame, a TCX decision is, nevertheless, taken for non-transient signals. Hence, the slightly less coding gain is accepted in favor of a better audio quality.

Thus, the present invention results in an improved compromise between quality and bitrate due to the fact that not only the quality of the encoded and again decoded signal is considered but, in addition, also the actually to be encoded input signal is analyzed with respect to its transient characteristic and the result of this transient analysis is used to additionally influence the decision for an algorithm better suited for transient signals or an algorithm better suited for stationary signals.

BRIEF DESCRIPTION OF THE DRAWINGS

Embodiments of the present invention will be detailed subsequently referring to the appended drawings, in which:

FIG. 2 illustrates a table for two different encoding algorithms and the signals for which they are suited;

FIG. 3 illustrates an overview over the quality condition, the transient condition and the hysteresis condition, which can be applied independently of each other, but which are, advantageously, applied jointly;

FIG. 4 illustrates a state table indicating whether a switchover is performed or not for different situations;

FIG. 6*a* illustrates a flowchart for determining the quality result in an embodiment;

FIG. 6*b* illustrates more details on the quality result of FIG. 6*a*.

DETAILED DESCRIPTION OF THE INVENTION

Figure 1:
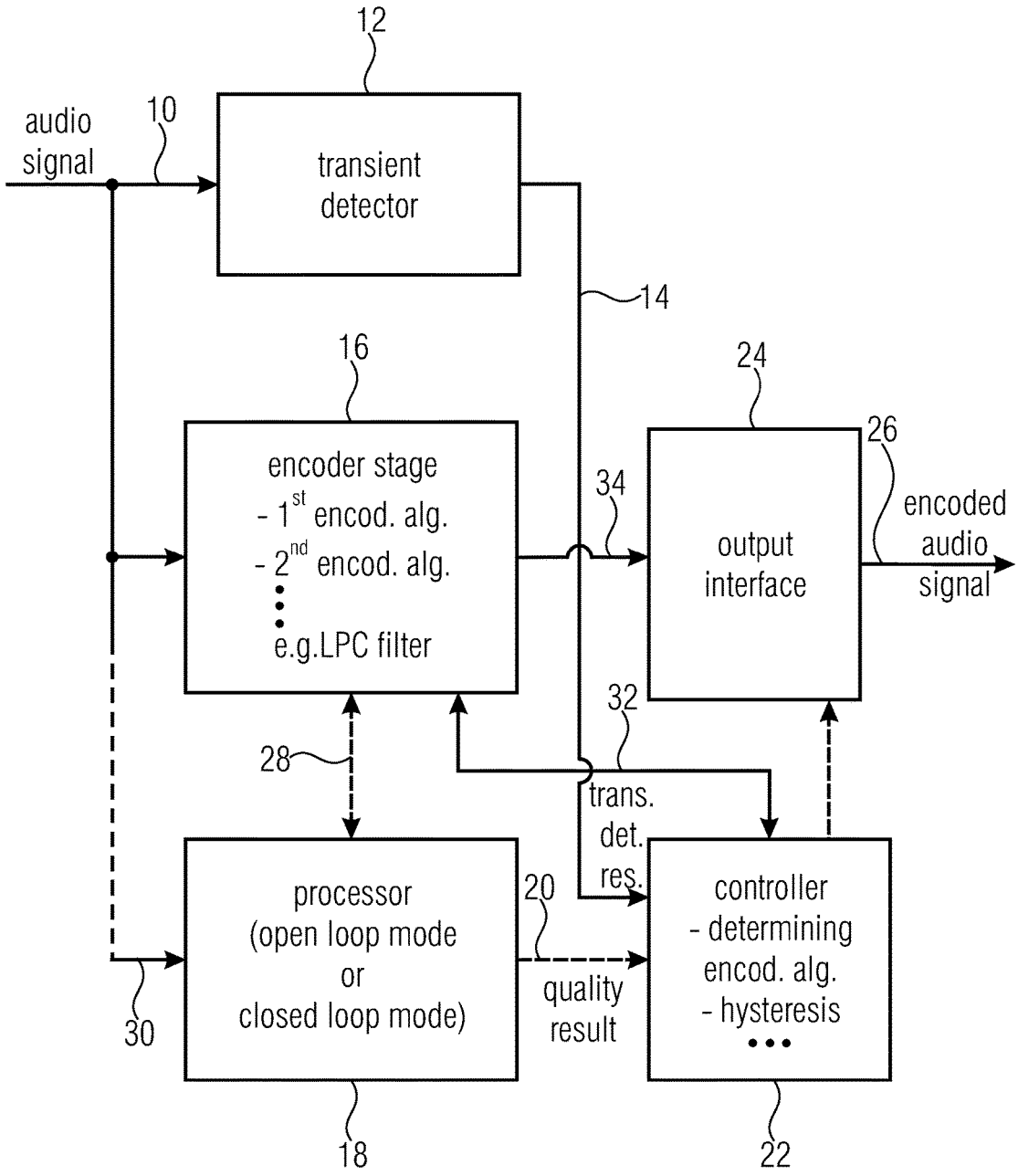
FIG. 1 illustrates a block diagram of an apparatus for coding a portion of an audio signal in accordance with an embodiment.

FIG. 1 illustrates an apparatus for coding a portion of an audio signal provided at an input line 10. The portion of the audio signal is input into a transient detector 12 for detecting whether a transient signal is located in the portion of the audio signal to obtain a transient detection result on line 14. Furthermore, an encoder stage 16 is provided where the encoder stage is configured for performing a first encoding algorithm on the audio signal, the first encoding algorithm having a first characteristic. Furthermore, the encoder stage 16 is configured for performing a second encoding algorithm on the audio signal, wherein the second encoding algorithm has a second characteristic which is different from the first characteristic.

Additionally, the apparatus comprises a processor 18 for determining which encoding algorithm of the first and second encoding algorithms results in an encoded audio signal being a better approximation to the portion of the original audio signal. The processor 18 generates a quality result based on this determination on line 20. The quality result on line 20 and the transient detection result on line 14 are both provided to a controller 22. The controller 22 is configured for determining whether the encoded audio signal for the portion of the audio signal is generated by either the first encoding algorithm or the second encoding algorithm. For this determination, not only the quality result 20, but also the transient detection result 14 are used. Furthermore, an output interface 24 is optionally provided where the output interface outputs an encoded audio signal as, for example, a bitstream or a different representation of an encoded signal on line 26.

In an implementation, where the encoder stage 16 performs an analysis by synthesis processing, the encoder stage 16 receives the same portion of the audio signal and encodes a portion of this audio signal by the first encoding algorithm to obtain the first encoded representation of the portion of the audio signal. Furthermore, the encoder stage generates an encoded representation of the same portion of the audio signal using the second encoding algorithm. Furthermore, the encoder stage 16 comprises, in this analysis by synthesis processing, decoders for both the first encoding algorithm and the second encoding algorithm. One corresponding decoder decodes the first encoded representation using a decoding algorithm associated with the first encoding algorithm. Furthermore, a decoder for performing a further decoding algorithm associated with the second encoding algorithm is provided so that, in the end, the encoder stage not only has the two encoded representations for the same portion of the audio signal, but also the two decoded signals for the same portion of the original audio signal on line 10. These two decoded signals are then provided to the processor via line 28 and the processor compares both decoded representations with the same portion of original audio signal obtained via input 30. Then, a segmental SNR for each encoding algorithm is determined This so-called quality result provides, in an embodiment, not only an indication of the better coding algorithm, i.e., a binary signal whether the first encoding algorithm or the second encoding algorithm has resulted in a better SNR. Additionally, the quality result indicates a quantitative information, i.e., how much better, for example in dB, the corresponding encoding algorithm is.

In this situation, the controller, when fully relying on the quality result 20, accesses the encoder stage via line 32 so that the encoder stage forwards the already stored encoded representation of the corresponding encoding algorithm to the output interface 24 so that this encoded representation represents the corresponding portion of the original audio signal in the encoded audio signal.

Alternatively, when the processor 18 performs an open-loop mode for determining the quality result, it is not necessary that both encoding algorithms are applied to one and the same audio signal portion. Instead, the processor 18 determines which encoding algorithm is better and, then, the encoder stage 16 is controlled via line 28 to only apply the encoding algorithm indicated by the processor and, then, this encoded representation resulting from the selected encoding algorithm is provided to the output interface 24 via line 34.

Depending on the specific implementation of the encoder stage 16, both encoding algorithms may operate in the LPC domain. In this case, such as for ACELP as the first encoding algorithm and TCX as the second encoding algorithm, a common LPC pre-processing is performed. This LPC pre-processing may comprise an LPC analysis of the portion of the audio signal, which determines the LPC coefficients for the portion of the audio signal. Then, an LPC analysis filter is adjusted using the determined LPC coefficients, and the original audio signal is filtered by this LPC analysis filter. Then, the encoder stage calculates a sample-wise difference between the output of the LPC analysis filter and the audio input signal in order to calculate the LPC residual signal which is then subjected to the first encoding algorithm or the second encoding algorithm in an open-loop mode or which is provided to both encoding algorithms in a closed-loop mode as described before. Alternatively, the filtering by the LPC filter and the sample-wise determination of the residual signal can be replaced by the FDNS (frequency domain noise shaping) technology described in the USAC standard.

FIG. 2 illustrates an advantageous implementation of the encoder stage. As the first encoding algorithm, the ACELP encoding algorithm having an CELP encoding characteristic is used. Furthermore, this encoding algorithm is better suited for transient signals. The second encoding algorithm has a coding characteristic which makes this second encoding algorithm better suited for non-transient signals. Exemplarily, a transform excitation coding algorithm such as TCX is used and, particularly, a TCX 20 encoding algorithm is advantageous which has a frame length of 20 ms (the window length can be higher due to an overlap) which makes the coding concept illustrated in FIG. 1 particularly suitable for low-delay implementations which may be used in real-time scenarios such as scenarios where there is a two-way communication as in telephone applications and, particularly, in mobile or cellular telephone applications.

However, the present invention is additionally useful in other combinations of first and second encoding algorithms. Exemplarily, the first encoding algorithm better suited for transient signals may comprise any of well-known time-domain encoders such as GSM-used encoders (G.729) or any other time-domain encoders. The non-transient signal encoding algorithm, on the other hand, can be any well-known transform-domain encoder such as MP3, AAC, AC3 or any other transform or filterbank-based audio encoding algorithm. For a low-delay implementation, however, the combination of ACELP on the one hand and TCX on the other hand, wherein, particularly, the TCX encoder can be based on an FFT or even more advantageously on an MDCT with a short window length is advantageous. Hence, both encoding algorithms operate in the LPC domain obtained by transforming the audio signal into the LPC domain using an LPC analysis filter. However, the ACELP then operates in the LPC-"time"-domain, while the TCX encoder operates in the LPC-"frequency"-domain.

Subsequently, an advantageous implementation of the controller 22 of FIG. 1 is discussed in the context of FIG. 3.

Advantageously, the switchover between the first encoding algorithm such as ACELP and the second encoding algorithm such as TCX 20 is performed using three conditions. The first condition is the quality condition represented by the quality result 20 of FIG. 1. The second condition is the transient condition represented by the transient detection result on line 14 of FIG. 1. The third condition is a hysteresis condition which relies on the decisions made by the controller 22 in the past, i.e., for the earlier portions of the audio signal.

The quality condition is implemented such that a switchover to the higher quality encoding algorithm is performed when the quality condition indicates a large quality distance between the first encoding algorithm and the second encoding algorithm. When, for example, it is determined that one encoding algorithm outperforms the other encoding algorithm by, for example, one dB SNR difference, then the quality condition determines a switchover or, stated differently, the actually used encoding algorithm for the actually considered portion of the audio signal irrespective of any transient detection or hysteresis situation.

When, however, the quality condition only indicates a small quality distance between both encoding algorithms such as the quality distance of one or less dB SNR difference, a switch over to the lower quality encoding algorithm may occur, when the transient detection result indicates that the lower quality encoding algorithm fits to the audio signal characteristic, i.e., whether the audio signal is transient or not. When, however, the transient detection result indicates that the lower quality encoding algorithm does not fit to the audio signal characteristic, then the higher quality encoding algorithm is to be used. In the latter case, once again, the quality condition determines the result, but only when a specific match between the lower quality encoding algorithm and the transient/stationary situation of the audio signal do not fit together.

The hysteresis condition is particularly useful in a combination with the transient condition, i.e., in that the switch to the lower quality encoding algorithm is only performed when less than the last N frames have been encoded with the other algorithm. In advantageous embodiments, N is equal to five frames, but other values advantageously lower or equal to N frames or signal portions, each comprising a minimum number of samples above e.g. 128 samples, can be used as well.

FIG. 4 illustrates a table of state changes depending on certain situations. The left column indicates the situation where the number of earlier frames is greater than N or smaller than N for either TCX or ACELP.

The last line indicates whether there is a large quality distance for TCX or a large quality distance for ACELP. In these two cases, which are the first two columns, a change is performed where indicated by an "X", while a change is not performed as indicated by "0".

Furthermore, the last two columns indicate the situation when a small quality distance for TCX is determined and when a transient signal is detected or when a small quality distance for an ACELP is determined and the signal portion is detected as being non-transient.

The first two lines of the last two columns both indicate that the quality result is decisive when the number of earlier frames is greater than 10. Hence, when there is a strong indication from the past for one coding algorithm, then the transient detection does not play a role, either.

When, however, the number of earlier frames being encoded in one of the two encoding algorithms is smaller than N, a switchover is performed from TCX to ACELP indicated at field 40 for transient signals. Additionally, as indicated in field 41, a change from ACELP to TCX is performed even when there is a small quality distance in favor of ACELP due to the fact that we have a non-transient signal. When the number of the last LCLP frames is smaller than N the subsequent frame is also encoded with ACELP and, therefore, no switchover is necessary as indicated at field 42. When, additionally, the number of TCX frames is smaller than N and when there is a small quality distance for ACELP and the signal is non-transient, the current frame is encoded using TCX and, no switchover is necessary as indicated by field 43. Hence, the influence of the hysteresis is clearly visible by comparing fields 42, 43 with the four fields above these two fields.

Hence, the present invention advantageously influences the hysteresis for the closed-loop decision by the output of a transient detector. Therefore, there does not exist, as in AMR-WB+, a pure closed-loop decision whether TCX or ACELP is taken. Instead, the closed-loop calculation is influenced by the transient detection result, i.e., every transient signal portion is determined in the audio signal. The decision whether an ACELP frame or TCX frame is calculated, therefore does not only depend on the closed-loop calculations, or, generally, the quality result, but additionally depends on whether a transient is detected or not.

In other words, the hysteresis for determining which encoding algorithm is to be used for the current frame can be expressed as follows:

When the quality result for TCX is slightly smaller than the quality result for ACELP, and when the currently considered signal portions or just the current frame is not transient, then TCX is used instead of ACELP.

When, on the other hand, the quality result for ACELP is slightly smaller than the quality result for TCX, and when the frame is transient, then ACELP is used instead of TCX. Advantageously, a flatness measure is calculated as the transient detection result, which is a quantitative number. When the flatness is greater than or equal to a certain value, then the frame is determined to be transient. When, on the other hand, the flatness is smaller than this threshold value, then it is determined that the frame is non-transient. As a threshold, the flatness measure of two is advantageous, where the calculation of the flatness is described in FIG. 5 in more detail.

Furthermore, as to the quality result, a quantitative measure is advantageous. When an SNR measure or, particularly, a segmental SNR measure is used, then the term "slightly smaller" as used before, may mean one dB smaller. Hence, when the SNRs for TCX and ACELP are more different from each other or stated differently, when the absolute difference between both SNR values is greater than one dB, then the quality condition of FIG. 3 alone determines the encoding algorithm for the current audio signal portion.

The above described decision can be furthermore elaborated, when the transient detection or the hysteresis output or the SNR of TCX or ACELP of the past or earlier frames is included into the if condition. Hence, a hysteresis is built which, for one embodiment, is illustrated in FIG. 3 as condition no. 3. Particularly, FIG. 3 illustrated the alternative when the hysteresis output, i.e., the determination for the past is used for modifying the transient condition.

Alternatively, a further hysteresis condition being based on the earlier TCX or ACELP-SNRs may comprise that a determination for the lower quality encoding algorithm is only performed when a change of the SNR difference with respect to the earlier frame is lower than, for example, a threshold. A further embodiment may comprise the usage of the transient detection result for one or more earlier frames when the transient detection result is a quantitative number. Then, a switchover to the lower quality encoding algorithm may, for example, only be performed when a change of quantitative transient detection result from the earlier frame to the current frame is, again, below a threshold. Other combinations of these figures for further modifying the hysteresis condition 3 of FIG. 3 can prove to be useful in order to obtain a better compromise between the bitrate on the one hand and the audio quality on the other hand.

Furthermore, the hysteresis condition as illustrated in the context of FIG. 3 and as described before can be used instead of or in addition to a further hysteresis which, for example, is based on internal analysis data of the ACELP and TCX encoding algorithms.

Figure 5:
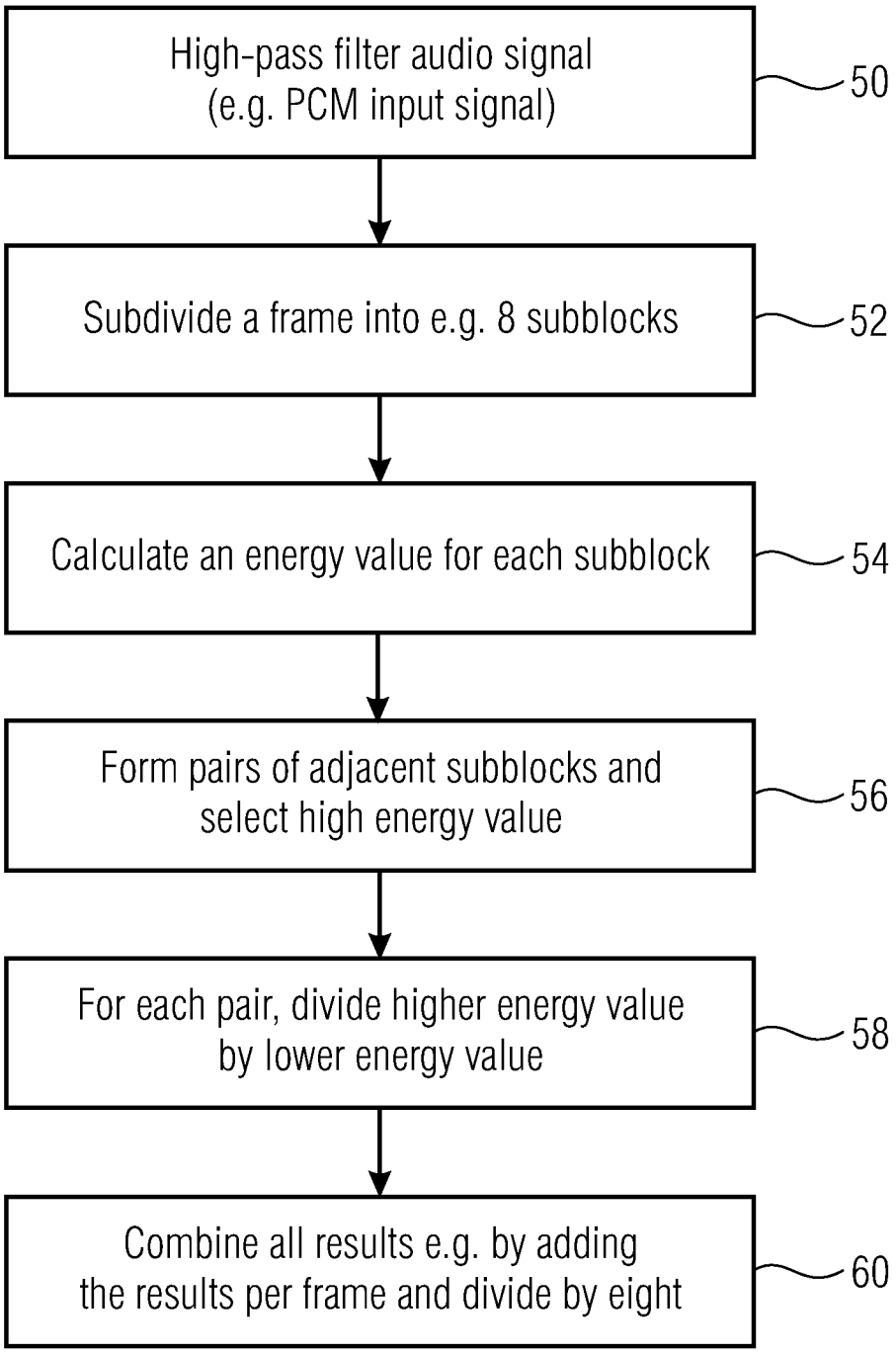
FIG. 5 illustrates a flowchart for determining the transient result in an embodiment.

Subsequently, reference is made to FIG. 5 for illustrating the advantageous determination of the transient detection result on line 14 of FIG. 1.

In step 50, the time-domain audio signal such as a PCM input signal on line 10 is high-pass filtered to obtain a high-pass filtered audio signal. Then, in step 52, the frame of the high-pass filtered signal which can be equal to the portion of the audio signal is sub-divided into a plurality of, for example, eight sub-blocks. Then, in step 54, an energy value for each sub-block is calculated. This energy calculation can comprise a squaring of each sample value in the sub-block and a subsequent addition of the squared samples with or without an averaging. Then, in step 56, pairs of adjacent sub-blocks are formed. The pairs can comprise a first pair consisting of the first and the second sub-block, a second pair consisting of the second and third sub-block, a third pair consisting of the third and fourth sub-block, etc. Additionally, a pair comprising the last sub-block of the earlier frame and the first sub-block of the current frame can be used as well. Alternatively, other ways of forming pairs can be performed such as, for example, only forming pairs of the first and second sub-block, of the third and fourth sub-block, etc. Then, as also outlined in block 56 of FIG. 5, the higher energy value of each sub-block pair is selected and, as outlined in step 58, divided by the lower energy value of the sub-block pair. Then, as outlined in block 60 of FIG. 5, all results of step 58 for a frame are combined. This combination may consist of an addition of the results of block 58 and an averaging where the result of the addition is divided by the number of pairs such as eight, when eight pairs per sub-block were determined in block 56. The result of block 60 is the flatness measure which is used by the controller 22 in order to determine whether a signal portion is transient or not. When the flatness measure is greater than or equal to 2, a transient signal portion is detected, while, when the flatness measure is lower than 2, it is determined that a signal is non-transient or stationary. However, other thresholds between 1.5 and 3 can be used as well, but it has been shown that the threshold of two provides the best results.

It is to be noted that other transient detectors can be used as well. Transient signals may additionally comprise voiced speech signals. Traditionally, transient signals comprise applause like signals or castagnets or speech plosives comprising signals obtained by speaking characters "p" or "t" or the like. However, vocals such as "a", "e", "i", "o", "u" are not meant to be transient signals in the classical approach, since same are characterized by periodic glottal or pitch pulses. However, since vocals also represent voiced speech signals, vocals are also considered to be transient signals for the present invention. The detection of those signals can be done, in addition or alternative to the procedure in FIG. 5, by speech detectors distinguishing voiced speech from unvoiced speech or by evaluating metadata associated with an audio signal and indicating, to a metadata evaluator, whether the corresponding portion is a transient or non-transient portion.

Subsequently, FIG. 6*a* is described in order to illustrate the third way of calculating the quality result on line 20 of FIG. 1, i.e., how the processor 18 is advantageously configured.

In block 61, a closed-loop procedure is described where, for each of a plurality of possibilities, a portion is encoded and decoded using the first and second coding algorithms. Then, in step 63, a measure such as a segmental SNR is calculated depending on the difference of the encoded and again decoded audio signal and the original signal. This measure is calculated for both encoding algorithms.

Then, an average segmental SNR using the individually segmental SNRs is calculated in step 65, and this calculation is again performed for both encoding algorithms so that, in the end, step 65 results in two different averaged SNR values for the same portion of the audio signal. The difference between these segmented SNR values for a frame is used as the quantitative quality result on line 20 of FIG. 1.

FIG. 6*b* illustrates two equations, where the upper equation is used in block 63, and where the lower equation is used in block 65. $\hat{x}_w$ stands for the weighted audio signal, and $\hat{x}_w$ stands for the encoded and again decoded weighted signal.

The averaging performed in block 65 is an averaging over one frame, where each frame consists of a number of subframes $N_{SF}$, and where four such frames together form a superframe. Hence, a superframe comprises 1024 samples, an individual frame comprises 2056 samples, and each subframe, for which the upper equation in FIG. 6*b* or step 63 is performed, comprises 64 samples. In the upper equation used in block 63, n is the sample number index and N is the maximum number of samples in the subframe equal to 63 indicating that a subframe has 64 samples.

Figure 7:
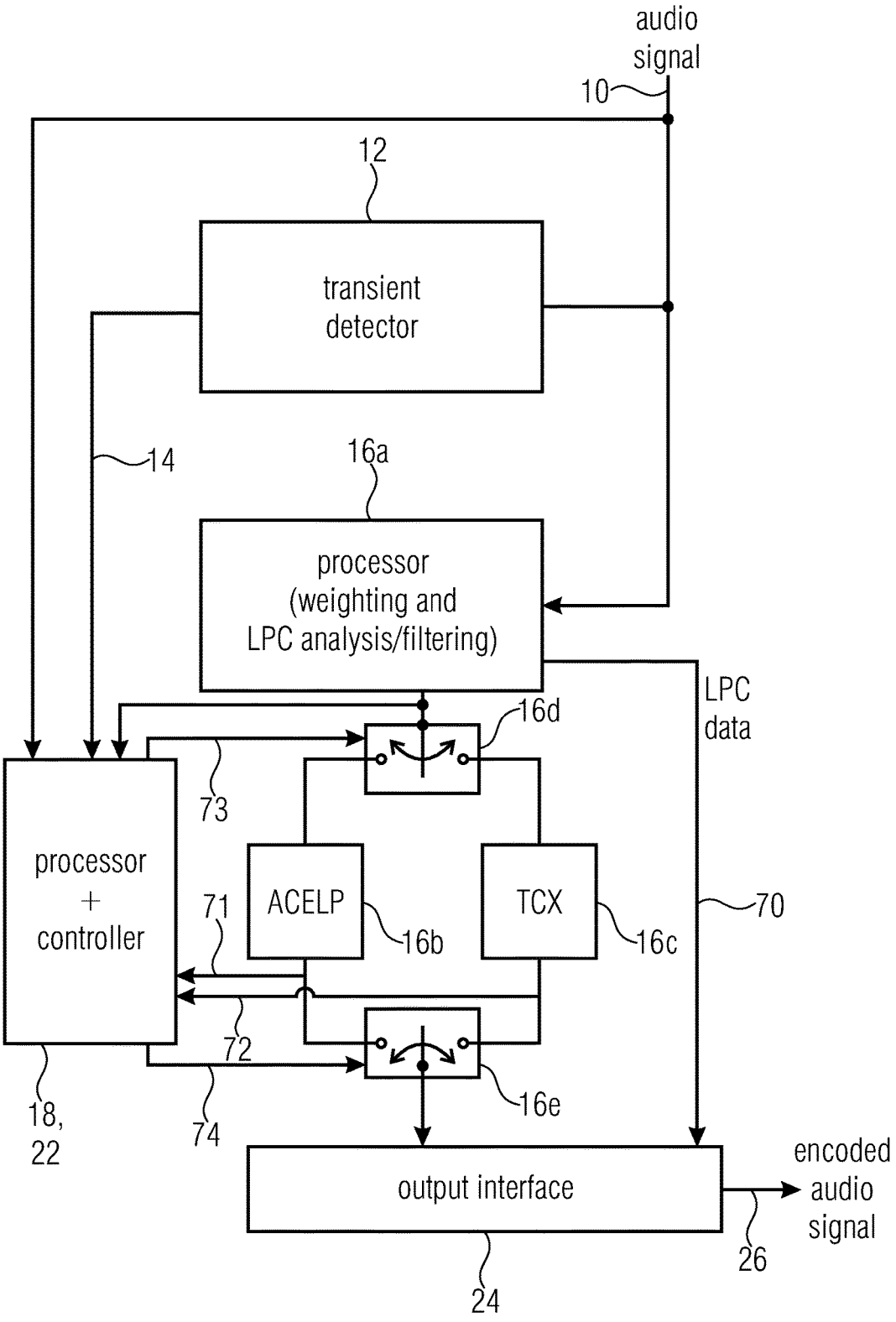
FIG. 7 illustrates a more detailed block diagram of an apparatus for coding in accordance with an embodiment.

FIG. 7 illustrates a further embodiment of the inventive apparatus for encoding, similar to the FIG. 1 embodiment, and the same reference numerals indicate similar elements. However, FIG. 7 illustrates a more detailed representation of the encoder stage 16, which comprises a pre-processor 16*a* for performing a weighting and LPC analysis/filtering, and the pre-processor block 16*a* provides LPC data on line 70 to the output interface 24. Furthermore, the encoder stage 16 of FIG. 1 comprises the first encoding algorithm at 16*b* and the second encoding algorithm at 16*c* which are the ACELP encoding algorithm and the TCX encoding algorithm, respectively.

Furthermore, the encoder stage 16 may comprise either a switch 16*d* connected before the blocks 16*d*, 16*c* or a switch 16*e* connected subsequent to the blocks 16*b*, 16*c*, where "before" and "subsequent" refer to the signal flow direction which is at least with respect to block 16*a* to 16*e* from top to bottom of FIG. 7. Block 16*d* will not be present in a closed-loop decision. In this case, only switch 16*e* will be present, since both encoding algorithms 16*b*, 16*c* operate on one and the same portion of the audio signal and the result of the selected encoding algorithm will be taken out and forwarded to the output interface 24.

If, however, an open-loop decision or any other decision is performed before both encoding algorithms operate on one and the same signal, then switch 16*e* will not be present, but the switch 16*d* will be present, and each portion of the audio signal will only be encoded using either one of blocks 16*b*, 16*c*.

Furthermore, particularly for the closed-loop mode, the outputs of both blocks are connected to the processor and controller block 18, 22 as indicated by lines 71, 72. The switch control takes place via lines 73, 74 from the processor and controller block 18, 22 to the corresponding switches 16*d*, 16*e*. Again, depending on the implementation, only one of lines 73, 74 will typically be there.

The encoded audio signal 26 therefore, comprises, among other data, the result of an ACELP or TCX which will typically be redundancy-encoded in addition such as by Huffman-coding or arithmetic coding before being input into the output interface 24. Additionally, the LPC data 70 are provided to the output interface 24 in order to be included in the encoded audio signal. Furthermore, it is advantageous to additionally include a coding mode decision into the encoded audio signal indicating to a decoder that the current portion of the audio signal is an ACELP or a TCX portion.

Although some aspects have been described in the context of an apparatus, it is clear that these aspects also represent a description of the corresponding method, where a block or device corresponds to a method step or a feature of a method step. Analogously, aspects described in the context of a method step also represent a description of a corresponding block or item or feature of a corresponding apparatus.

Depending on certain implementation requirements, embodiments of the invention can be implemented in hardware or in software. The implementation can be performed using a digital storage medium, for example a floppy disk, a DVD, a CD, a ROM, a PROM, an EPROM, an EEPROM or a FLASH memory, having electronically readable control signals stored thereon, which cooperate (or are capable of cooperating) with a programmable computer system such that the respective method is performed.

Some embodiments according to the invention comprise a non-transitory data carrier having electronically readable control signals, which are capable of cooperating with a programmable computer system, such that one of the methods described herein is performed.

Generally, embodiments of the present invention can be implemented as a computer program product with a program code, the program code being operative for performing one of the methods when the computer program product runs on a computer. The program code may for example be stored on a machine readable carrier.

Other embodiments comprise the computer program for performing one of the methods described herein, stored on a machine readable carrier.

In other words, an embodiment of the inventive method is, therefore, a computer program having a program code for performing one of the methods described herein, when the computer program runs on a computer.

A further embodiment of the inventive methods is, therefore, a data carrier (or a digital storage medium, or a computer-readable medium) comprising, recorded thereon, the computer program for performing one of the methods described herein.

A further embodiment of the inventive method is, therefore, a data stream or a sequence of signals representing the computer program for performing one of the methods described herein. The data stream or the sequence of signals may for example be configured to be transferred via a data communication connection, for example via the Internet.

A further embodiment comprises a processing means, for example a computer, or a programmable logic device, configured to or adapted to perform one of the methods described herein.

A further embodiment comprises a computer having installed thereon the computer program for performing one of the methods described herein.

In some embodiments, a programmable logic device (for example a field programmable gate array) may be used to perform some or all of the functionalities of the methods described herein. In some embodiments, a field programmable gate array may cooperate with a microprocessor in order to perform one of the methods described herein. Generally, the methods are advantageously performed by any hardware apparatus.

While this invention has been described in terms of several embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations and equivalents as fall within the true spirit and scope of the present invention.

The invention claimed is:

1. An apparatus for coding a portion of an audio signal to acquire an encoded audio signal for the portion of the audio signal, comprising:

a transient detector configured for detecting whether a transient signal is located in the portion of the audio signal to achieve a transient detection result for the portion of the audio signal;

an encoder stage configured for performing a first encoding algorithm on the portion of the audio signal to obtain a first quality result value for the portion of the audio signal, the first encoding algorithm comprising a first characteristic, and for performing a second encoding algorithm on the same portion of the audio signal from which the first quality result value was derived, to obtain a second quality result value for the portion of the audio signal, the second encoding algorithm comprising a second characteristic being different from the first characteristic;

a processor configured for determining which encoding algorithm of the first and second encoding algorithms results in the encoded audio signal for the portion of the audio signal being a better approximation to the portion of the audio signal with respect to the other encoding algorithm of the first and second encoding algorithms to achieve a quality result for the portion of the audio signal, wherein the processor is configured to determine the quality result as a distance between the first quality result value and the second quality result value;

a controller configured for determining whether the encoded audio signal for the portion of the audio signal is to be generated using either the first encoding algorithm or the second encoding algorithm based on the transient detection result for the portion of the audio signal and the quality result for the same portion of the audio signal; and an output interface for outputting, for the portion of the audio signal, the encoded signal being either generated using the first encoding algorithm or generated using the second encoding algorithm, wherein the encoder stage is configured for using the first encoding algorithm which is better suited for transient signals than the second encoding algorithm, wherein the controller is configured for determining the second encoding algorithm, although the quality result indicates a better quality for the first encoding algorithm, when the transient detection result indicates a non-transient signal and when the quality result indicates a distance between the encoding algorithms, which is smaller than a threshold distance value, or wherein the controller is configured for determining the first encoding algorithm, although the quality result indicates a better quality for the second encoding algorithm, when the transient detection result indicates a transient signal and when the quality result indicates the distance between the encoding algorithms, which is smaller than the threshold distance value, and wherein at least one of the transient detector, the encoder stage, the processor, the controller, or the output interface comprises a hardware implementation.

2. The apparatus of claim 1, wherein the first encoding algorithm is an ACELP coding algorithm, and wherein the second encoding algorithm is a transform coding algorithm.

3. The apparatus in accordance with claim 1, wherein the threshold distance value is equal to or lower than 3 dB, and wherein the quality result values for both encoding algorithms are calculated using an SNR calculation between the audio signal and an encoded and again decoded version of the audio signal.

4. The apparatus in accordance with claim 1, wherein the controller is configured to only determine the second encoding algorithm or the first encoding algorithm, when a number of earlier signal portions for which the first or second encoding algorithm has been determined is smaller than a predetermined number.

5. The apparatus in accordance with claim 4, wherein the controller is configured to use a predetermined value being smaller than 10.

6. The apparatus in accordance with claim 1, wherein the controller is configured for applying a hysteresis processing so that the second encoding algorithm or the first encoding algorithm is only determined when the lower quality result value among the first and the second quality result values indicates a lower quality for the second encoding algorithm or the first encoding algorithm, when a number of earlier signal portions comprising the first encoding algorithm or the second encoding algorithm, respectively, is equal or lower than a predetermined number, and when the transient detection result indicates a predefined state of the two possible states comprising non-transients and transients.

7. The apparatus in accordance with claim 1, wherein the transient detector is configured to perform the following:

high-pass filtering of the audio signal to acquire a high-pass filtered signal block;

subdividing of the high-pass filtered signal block into a plurality of sub-blocks;

calculating an energy for each sub-block;

combining of the energy values for each pair of adjacent sub-blocks to achieve a result for each pair; and combining of the results for the pairs to achieve the transient detection result.

8. The apparatus in accordance with claim 1, wherein the encoder stage further comprises an LPC filtering stage for determining LPC coefficients from the audio signal for filtering the audio signal using an LPC analysis filter determined by the LPC coefficients to determine a residual signal, wherein the first encoding algorithm or the second encoding algorithm is applied to the residual signal, and wherein the encoded audio signal further comprises information on the LPC coefficients.

9. The apparatus in accordance with claim 1, wherein the encoding stage either comprises a switch connected to the first encoding algorithm and the second encoding algorithm or a switch connected subsequently to the first encoding algorithm and the second encoding algorithm, wherein the switch is controlled by the controller.

10. A method of coding a portion of an audio signal to acquire an encoded audio signal for the portion of the audio signal, comprising:

detecting, by a transient detector, whether a transient signal is located in the portion of the audio signal to achieve a transient detection result for the portion of the audio signal;

performing, by an encoder stage, a first encoding algorithm on the portion of the audio signal to obtain a first quality result value for the portion of the audio signal, the first encoding algorithm comprising a first characteristic, and performing a second encoding algorithm on the same portion of the audio signal from which the first quality result value was derived, to obtain a second quality result value for the portion of the audio signal, the second encoding algorithm comprising a second characteristic being different from the first characteristic;

determining, by a processor, which encoding algorithm of the first and second encoding algorithms results in the encoded audio signal being a better approximation to the portion of the audio signal with respect to the other encoding algorithm of the first and second encoding algorithms to achieve a quality result for the portion of the audio signal, wherein the determining comprises determining the quality result as a distance between the first quality result value and the second quality result value; and determining, by a controller, whether the encoded audio signal for the portion of the audio signal is to be generated using either the first encoding algorithm or the second encoding algorithm based on the transient detection result for the same portion of the audio signal and the quality result for the portion of the audio signal; and outputting, by an output interface, for the portion of the audio signal, the encoded signal being either generated using the first encoding algorithm or generated using the second encoding algorithm, wherein the first encoding algorithm is better suited for transient signals than the second encoding algorithm, wherein the determining whether the encoded audio signal for the portion of the audio signal is to be generated using either the first encoding algorithm or the second encoding algorithm comprises determining the second encoding algorithm, although the quality result indicates a better quality for the first encoding algorithm, when the transient detection result indicates a non-transient signal and when the quality result indicates a distance between the encoding algorithms, which is smaller than a threshold distance value, or wherein the determining whether the encoded audio signal for the portion of the audio signal is to be generated using either the first encoding algorithm or the second encoding algorithm comprises determining the first encoding algorithm, although the quality result indicates a better quality for the second encoding algorithm, when the transient detection result indicates a transient signal and when the quality result indicates the distance between the encoding algorithms, which is smaller than the threshold distance value, wherein at least one of the transient detector, the encoder stage, the processor, the controller, or the output interface comprises a hardware implementation.

11. A non-transitory storage medium having stored thereon a computer program comprising a program code for performing, when running on a computer, a method of coding a portion of an audio signal to acquire an encoded audio signal for the portion of the audio signal, the method comprising:

detecting whether a transient signal is located in the portion of the audio signal to achieve a transient detection result for the portion of the audio signal;

performing a first encoding algorithm on the portion of the audio signal to obtain a first quality result value for the portion of the audio signal, the first encoding algorithm comprising a first characteristic, and performing a second encoding algorithm on the same portion of the audio signal from which the first quality result value was derived to obtain a second quality result value for the portion of the audio signal, the second encoding algorithm comprising a second characteristic being different from the first characteristic;

determining which encoding algorithm of the first and second encoding algorithms results in the encoded audio signal being a better approximation to the portion of the audio signal with respect to the other encoding algorithm of the first and second encoding algorithms to achieve a quality result for the portion of the audio signal, wherein the determining comprises determining the quality result as a distance between the first quality result value and the second quality result value;

determining whether the encoded audio signal for the portion of the audio signal is to be generated using either the first encoding algorithm or the second encoding algorithm based on the transient detection result for the same portion of the audio signal and the quality result for the portion of the audio signal; and outputting, for the portion of the audio signal, the encoded signal being either generated using the first encoding algorithm or generated using the second encoding algorithm, wherein the first encoding algorithm is better suited for transient signals than the second encoding algorithm, wherein the determining whether the encoded audio signal for the portion of the audio signal is to be generated using either the first encoding algorithm or the second encoding algorithm comprises determining the second encoding algorithm, although the quality result indicates a better quality for the first encoding algorithm, when the transient detection result indicates a non-transient signal and when the quality result indicates a distance between the encoding algorithms, which is smaller than a threshold distance value, or wherein the determining whether the encoded audio signal for the portion of the audio signal is to be generated using either the first encoding algorithm or the second encoding algorithm comprises determining the first encoding algorithm, although the quality result indicates a better quality for the second encoding algorithm, when the transient detection result indicates a transient signal and when the quality result indicates the distance between the encoding algorithms, which is smaller than the threshold distance value.

* * * * *